United States Patent [19]

Mathews et al.

[11] Patent Number: 5,005,807

[45] Date of Patent: Apr. 9, 1991

[54] EXTENSION BAR FOR BLAST FURNACE TAP HOLE DRILL

[75] Inventors: Ronald J. Mathews, Valencia; Robert T. Woodings, Pittsburgh, both of Pa.

[73] Assignee: Woodings Industrial Corporation, Mars, Pa.

[21] Appl. No.: 504,603

[22] Filed: Apr. 4, 1990

[51] Int. Cl.[5] ..... C21C 5/48

[52] U.S. Cl. ..... 266/271; 408/226

[58] Field of Search ..... 266/45, 271, 136; 408/241 B, 226

[56] References Cited

FOREIGN PATENT DOCUMENTS 2093292 1/1972 France ..... 266/271

*Primary Examiner*—S. Kastler

*Attorney, Agent, or Firm*—Waldron & Associates

[57] ABSTRACT

An improved extension bar for a drill rod assembly on a blast furnace tap hole drill having an increased diameter sufficient to occupy a significant portion of tap hole drilled so as to minimize the volume of blast furnace hot metal that can emerge from the blast furnace before the striking bas assembly can be removed, and having a protective sleeve portion at the rearward end thereof to shield and protect the interface between the drill rod and extension bar to prevent such interface from being exposed the hot metal and thereby avoid the possibility that they could become welded together.

17 Claims, 2 Drawing Sheets

EXTENSION BAR FOR BLAST FURNACE TAP HOLE DRILL

BACKGROUND OF THE INVENTION

1. Field of the Invention

The present invention relates to the art of opening blast furnace tap holes and to blast furnace tap hole drills, and more particularly to new and improved extension bar as typically utilized within drill rod assemblies on such tap hole drills. The extension bar of this invention will have a longer useful life and minimize the tendency for it to become welded to the drill rod, or in particular being partially destroyed by molten metal, thereby facilitating its easy removal to further extend the average useful life of the drill rod.

2. Summary of the Prior Art

It is well known that the hearth of an iron blast furnace is provided with a tap hole, commonly referred to as a "iron notch", through which molten iron, usually referred to as "hot metal", is drawn off at periodic intervals during the blast furnace campaign. During a normal campaign, such tapping must be done on an average of five to twelve times daily, as the blast furnace hearth becomes filled with molten iron and slag. After the blast furnace has been tapped, i.e. the molten hot metal and slag drained therefrom, the tap hole or iron notch is plugged with clay or "mud" which will harden and seal the tap hole until the next time the blast furnace is tapped.

In accordance with usual practices, a special drill is utilized to open a tap hole, i.e. drill a passageway through the hardened clay plugging the iron notch, for the purposes of tapping the blast furnace. Such blast furnace tap hole drills are normally pneumatically or hydraulically operated rotary percussion drills comparable to the rock drills utilized in the mining industry. Such drills impart both a rotary and an impact force on an elongated drill rod having a rock drill bit at the end toward the iron notch.

The base support for the blast furnace tap hole drill is normally secured to the floor, a structural column or some solid base structure, and is provided with suitable linkage members and remote controls so that the blast furnace tap hole drill can be remotely operated to move the drill into the proper position for drilling the tap hole, then operated to drill the tap hole, and thereafter, moved back away from the tap hole and heat of the emerging hot metal, where the drill can be serviced and prepared for the next tap.

To prepare the blast furnace tap hole drill for each succeeding tap, it is always necessary to replace the drill bit, if not the drill rod or a portion thereof. This is because the temperature of the blast furnace hot metal, being about 2700–2800° F., severely erodes the drill bit after it drills through the clay plug and enters the bath of molten hot metal. In addition, once the tap hole is drilled, the ferrostatic head of hot metal within the blast furnace will cause the hot metal to emerge through the tap hole around the drill bit and drill rod before the drill rod and bit can be withdrawn from the tap hole. Often times, the drill bit will not only be severely eroded but the portion remaining will virtually be "welded" to the end of the drill rod to which it had previously been removably attached. In such an event, it will be impossible to remove the drill bit from the drill rod to replace a new drill bit, and accordingly it then becomes necessary to replace the entire drill bit and adjoining drill rod or drill rod component to which it is welded.

To reduce the expense of replacing the entire drill rod and bit assembly, it has become common practice to utilize a drill rod extension bar, which is merely a removable portion of the drill rod, typically from 18 to 30 inches in length, fitted between the elongated rearward portion of the drill rod and the drill bit. Therefore, when the drill bit becomes welded to the extension bar, or the extension bar otherwise damaged, the bit and extension bar can be replaced without the need for replacing the elongated drill rod or entire drill rod assembly.

In utilizing and extension bar, however, it still at times happens that the outward pouring of hot metal around the extension bar, as above noted, will cause severe erosion at the interface between the extension bar and drill rod, often times welding even these two components together. In such an event, it will still be necessary to replace the entire drill rod assembly. Even though the drill rod, extension bar and coupling are sometimes provided with a protective ceramic coating, the hot metal often attacks, erodes and welds the uncoated contacting interfaces between the coupling and extension bar or drill rod, just as it attacks the interface between the drill bit and extension bar.

While it is of course possible to remove the drill bit from the extension bar or the extension bar from the drill rod with an acetylene cutting torch, use of this procedure will usually damage the threaded ends of the extension bar or drill rod so severely that they cannot be reused anyway, so that nothing useful can be salvaged by using this technique.

SUMMARY OF THE INVENTION

This invention is predicated upon the conception and development of a new and improved extension bar which self shields its interface with the drill rod, and in addition significantly reduces the amount of hot metal flowing therepast, with both features serving to greatly minimize the tendency for the connected components to become welded together. Accordingly, this inventive extension bar will render the components more easily removable from each other after the tap hole has been drilled, thereby significantly extending the average useful life of both the drill rod and extension bar.

Pursuant to this invention, the interface connection between the inventive extension bar and the drill rod will rarely, if ever, be exposed to hot metal, which will thereby result in the ability to salvage many drill rods which would otherwise have to be scrapped merely by virtue of the fact that it could not be separated from a damaged extension bar welded thereto. In addition, the physical proportions of the inventive extension bar are such that damage thereto will be greatly minimized. Pursuant to this invention, the average useful life of both the drill rod and extension bar will be greatly increased so that the cost of maintaining spare parts will be greatly reduced.

DETAILED DESCRIPTION OF THE INVENTION

Figure 1:
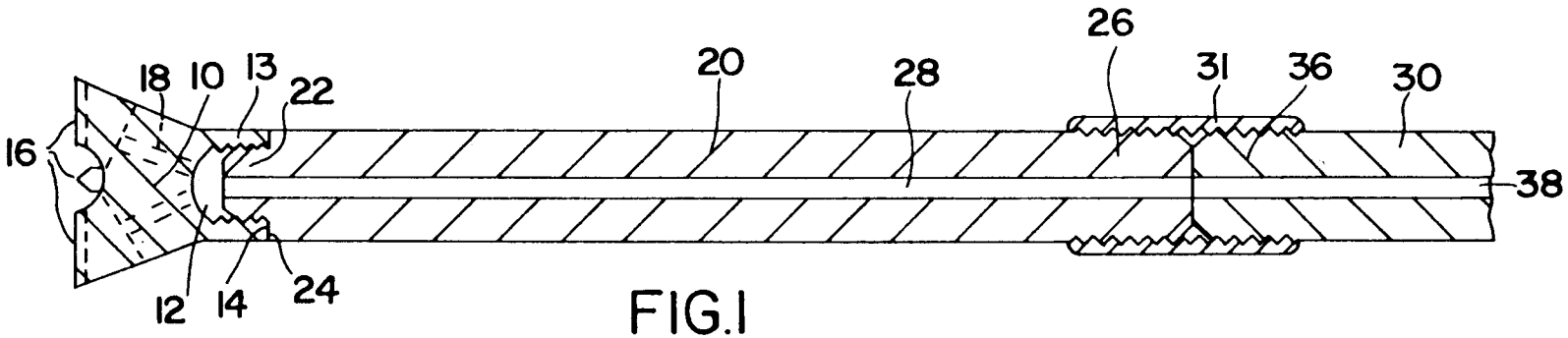
FIG. 1 PRIOR ART
FIG. 1 is a cross-sectional side view illustrating a typical drill rod assembly as utilized in the prior art, showing the connections between the drill bit and extension bar, and between the extension bar and the drill rod.

Reference to FIG. 1 will illustrate the prior art technique for interconnecting the drill rod assembly wherein a drill bit 10 is connected to an extension bar 20, and extension bar 20 is connected to a drill rod 30. While it is recognized that the drill bit 10 can be directly attached to the drill rod 30, without utilizing a removable extension bar 20, such practice has become rather rare.

As can be seen in FIG. 1, one end of the extension bar 20 is provided with a threaded extension head portion 22 which mates with the threaded pilot hole 12 in the shank 13 of drill bit 10. The threaded portion of pilot hole 12 is deeper than the length of threaded head portion 22, so that the annular edge rim 14 on shank 13 will tighten against shoulder 24 on extension bar 20 to tightly secure drill bit 10 onto extension bar 20.

To secure extension bar 20 to drill rod 30, the customary practice has been to machine threads into the adjoining ends thereof 26 and 36 respectively, and join them together with a conventional tubular coupling 31.

As can further be seen from FIG. 1, the drill rod 30 and extension bar 20 are each provided with a port 38 and 28 respectively through their axis for the purpose of injecting air during the drilling operation. The injected air then passes through ports 18 in the drill bit 10 which emerges between the cutting tips 16 of drill bit 10 to purge drilling debris from the drilling site.

While the entire surface of drill bit 10 will be eroded when it comes into contact with the molten hot metal within the blast furnace, the ferrostatic head of hot metal within the furnace will cause the hot metal to emerge from the furnace and move along the periphery of the extension bar 20, if not also the drill rod 30, as previously noted. For this reason, it is customary practice to coat the outer surfaces of the extension and drill rods 20 and 30 with a flame sprayed ceramic coating to protect them from being melted and eroded during that brief period of time before the drill rod assembly can be withdrawn from the tap hole. Although the extension bar 20 and drill rod 30 are somewhat protected by the ceramic coating, it is not uncommon for the hot metal to attack the uncoated interfaces between the component parts, melting and washing out metal at the interfaces between annular rim 14 and shoulder 24, as well as the threaded interface between coupling 31 and extension bar 20 and drill rod 30. Not only is the metal melted and washed from these interfaces, but often times the adjoining components are caused to be welded together at these sites as above discussed.

Figure 2:
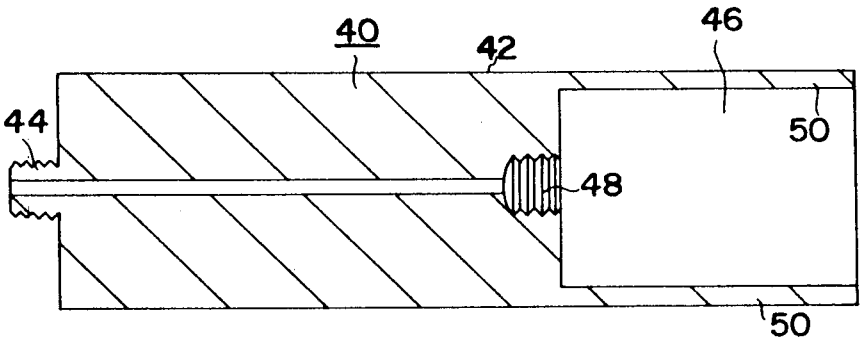
FIG. 2 is a cross-sectional side view illustrating one embodiment of an extension bar according to this invention.
Figure 3:
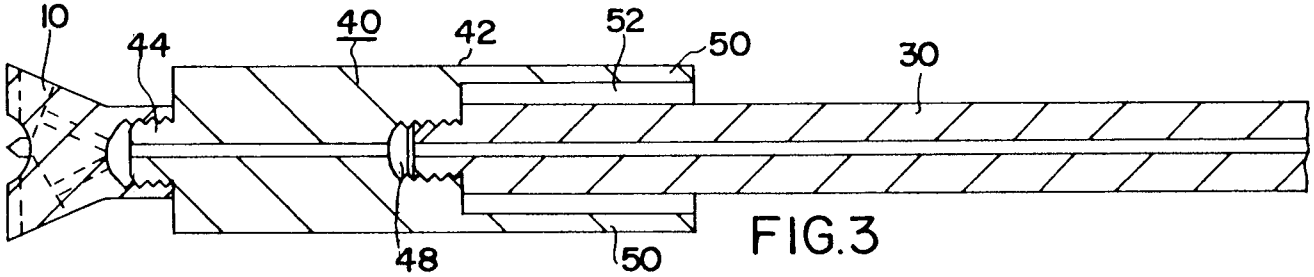
FIG. 3 is cross-sectional side view illustrating a drill rod assembly incorporating the extension bar of this invention.

Reference to FIGS. 2 and 3 will illustrate one embodiment of this invention wherein extension bar 40 comprises a cylindrical body portion 42 having a threaded head portion 44, to which the drill bit 10 is attached. The body portion 42 of the extension bar 40 has a larger than normal diameter, which, for obvious reasons, should be no greater than the drilling diameter of the drill bit 10 attached thereto. That is to say, the extension bar 40 must be able to follow drill bit 10 through the tap hole as the tap hole is drilled, and preferably therefore, should have a diameter somewhat less than the drilling diameter of drill bit 10. The rearward end of extension bar 40 is provided with a rather deep socket 46, and a threaded pilot hole 48 in the base thereof, to which drill rod 30 is to be attached. The socket 46 should have a diameter significantly greater than the diameter of drill rod 30 so that drill rod 30 can easily be inserted therein and be attached at pilot hole 48. Accordingly, the walls of socket 46 will provide a protective sleeve 50 extending a significant length beyond pilot hole 48, and over drill rod 30, such that an annular space will be provided between sleeve 50 and any bar thereunder, of conventional diameter, i.e. drill rod 30. When drill rod 30, of conventional diameter, is secured into pilot hole 48, protective sleeve 50 will extend well beyond the metal-to-metal interface between drill rod 30 and extension bar 40, to thereby shield the interface from exposure to any hot metal flowing over extension bar 40. While there will normally be a gap 52 between sleeve 50 and drill rod 30, testing has shown that there will be little probability that the hot metal, flowing over the cylindrical surface 42 in a direction away from drill bit 10, will back-flow into the gap 52. If it is found to be necessary, however, a ceramic mud or clay can be packed into the gap 52 to prevent any such back-flow. As is true for any exposed bar, extension bar 40 is preferably coated with a flame sprayed ceramic coating. It should be apparent, however, that since the forward end of drill rod 30 will be shielded by sleeve 50, that the shielded portion of drill rod 30 need not have a ceramic coating, as hot metal will not normally come into contact therewith.

The unique nature of extension bar 40 will offer a number of advantages. Firstly, it can readily be seen that sleeve 50 will provide shielding of the forward end of drill rod 30 and its interface with extension bar 40 so that it will not be likely for any hot metal to work its way back through gap 52 to melt and weld the components at the interface. If extension bar 40 is provided with a flame sprayed ceramic coating, its form and integrity should last through a very large number of taps. While the depth of socket 46 is not particularly critical, it should be at least about two inches so that cylindrical sleeve 50 will provide good and adequate shielding, with little probability that the hot metal will back flow into gap 52. Preferably, however, socket 46, i.e. sleeve 50, should have a depth or length of from 6 to 30 inches to assure adequate protection of the interface thereunder. The over-all length of length of extension bar 40 should be sufficient to assure that the rearward portion thereof, particularly to opening to gap 52, does not enter into the blast furnace after the tap hole is drilled.

In addition to the above, the increased diameter of extension bar 40 will provide an additional advantage in that it will occupy a more significant portion of the tap hole after it has been drilled, so that a smaller amount of hot metal will flow therepast from the blast furnace before the drill rod assembly can be removed from the tap hole. The reduced mass of hot metal flowing over the surface of the of the extension bar 40 will of course significantly lessen the probability that the emerging hot metal will melt, weld or otherwise damage the drill rod assembly.

Not only will the volume of hot metal flowing around the drill rod assembly be reduced, but the increased mass of metal in the over-sized extension bar 40 will provide greatly improved heat sink characteristics. As a result, the extension bar itself will remain cooler and less subject to damage, as well as maintaining the forward end of drill rod 30 significantly cooler and less subject to damage.

Pursuant to conventional practices, blast furnace tap hole drill are fitted with drill bit that will drill holes of from 2 to 2¾ inches in diameter, most typically 2¾ inches. With a 2¾ inch drill bit, the common practice has been to utilize drill rods and extension bars having diameters of either 1¼ or 1⅜ inch. Therefore, after the drill bit drills the tap hole through, an annular gap of from ½ to 5/8 inch is provided between the tap hole walls and the extension bar, through which a considerable amount of hot metal will emerge before the drill rod assembly can be removed from the tap hole. The use of an extension bar according to this invention can be utilized to significantly reduce this gap distance, and accordingly reduce the volume of hot metal that can flow therepast after the tap hole is drilled. In the above specific example, an extension bar according to this invention having a diameter of 2¼ inches will reduce the aforesaid gap distance to ¼ inch in a 2¾ inch tap hole, thereby reducing the cross-sectional opening by at least 50 percent, and obviously, reducing the amount of hot metal flowing thereover by a comparable figure. It should be appreciated, however, that this invention is not limited to an extension bar having any particular diameter, but rather to a diameter which is sufficiently greater than that of the drill rod so that a socket can be machined in the rearward end thereof, e.g. socket 46, as will provide a shield, e.g. protective sleeve 50 over that portion of the drill rod closest to the extension bar.

Figure 4:
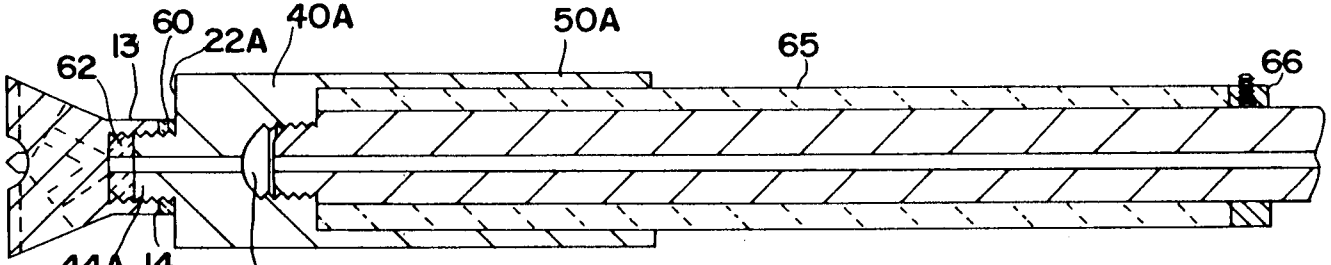
FIG. 4 is another cross-sectional side view similar to that shown in FIG. 3 but illustrating a somewhat modified embodiment incorporating a ceramic sleeve.

In the embodiment illustrated in FIG. 2, the interface between drill bit 10 and extension bar 40 is a connection pursuant to conventional prior art practices, and therefore, nothing is provided to prevent the drill bit 10 and extension bar 40 from becoming welded together. The reduced mass of hot metal emerging from the blast furnace over the inventive extension bar 40, in combination with the increased mass of the extension bar itself, will both serve to greatly reduce the probability for welding. The probability for such welding can be even further minimized by providing a ceramic washer or sleeve at the outer interface between the drill bit and extension bar as described in co-pending patent application, Ser. No. 07/504,440. Reference to FIG. 4 will illustrate another embodiment of this invention incorporating such a ceramic washer. As shown in FIG. 4, a ceramic washer 60 is positioned over threaded head portion 44A and a ceramic plug 62 is places within the pilot hole of drill bit 10, before drill bit 10 is attached to extension bar 40A. Accordingly, ceramic washer 60 will be disposed between the annular rim surface 14 on drill bit shank 13 and the front face 22A of extension bar 40A so that the otherwise abutting metal-to-metal surfaces 14 and 22A are not in contact. Therefore, washer 60 will serve to prevent hot metal from washing into the interface and welding the two components together. While hot metal may and will at time wash into the interfaces between ceramic washer 60 and the two abutting metal surfaces, 14 and 22A, and melt portions of those metal surfaces, ceramic washer 60 will not be melted, but will remain in place to provide a physical barrier between the opposed metal surfaces to keep them from becoming welded together.

Ceramic plug 62 will further serve to prevent drill bit 10 from becoming welded to extension bar 40A by providing a ceramic barrier at the base of the pilot hole, and may further be utilized to provide a base surface upon which drill bit 10 and head portion 44A will seat and tighten to prevent excessive compressive loading on washer 60, which could otherwise be fractured. As noted in the above mentioned co-pending application, ceramic washer 60 and ceramic plug 62 may consist entirely of a ceramic material or a metallic base material such as steel having a ceramic coating. The aforesaid patent application teaches other embodiments including ceramic sleeves which could be utilized with equal advantage in combination with the unique extension bar of this invention.

Another unique feature illustrated in FIG. 4, is the ceramic sleeve 65 disposed between protective sleeve 50A and drill rod 30, which is held in place by a slip collar 66. In this embodiment, ceramic sleeve 65 will serve to provide additional protection of the forward end of drill rod 30 and its interface connection to extension bar 40A.

While the ceramic materials utilized in the above described embodiments of this invention are not critical, it should be readily apparent that the material chosen should be one that retains its solid form at temperatures up to at least 2800° F., and not be chemically attacked by the molten hot metal. In addition, the chosen material should be one that has some degree of compression strength, so that it is not easily fractured when the component parts of the striker bar are threaded together, as well as having general toughness to withstand the impacting shocks caused when the drill is in service. The materials found to be most advantageous are the oxides having a relatively low thermal conductivity such as zirconia and titania. The most preferred washer is one made of a conventional steel washer having a flame sprayed coating of zirconia or the like.

In view of the embodiments and variations of this invention as described above, it should be apparent that numerous other embodiments, variations and modifications could be incorporated without departing from the spirit of the invention, including the incorporation of any one or more of the ceramic protecting devices as disclosed and claimed in the above mentioned co-pending patent application.

What is claimed is:

1. An extension bar for a blast furnace tap hole drill comprising an elongated body portion having a forward end and a rearward end, means at said forward end for securing a drill bit, and a socket at said rearward end having a base and forming a protective sleeve with said body portion extending rearward from said base, said socket having a diameter sufficient to receive a forward end of a drill rod and provide an annular gap between said drill rod and said sleeve and having means at said base for securing said drill rod such that said protective sleeve will shield the forward end of said drill rod and any metal-to-metal interface between said drill rod and said extension bar.

2. An extension bar for a blast furnace tap hole drill according to claim 1 wherein said means for securing a drill bit comprises a threaded head portion onto which said drill bit can be secured.

3. An extension bar for a blast furnace tap hole drill according to claim 1 wherein said means for securing a drill rod comprised a threaded pilot hole into which said drill rod can be secured.

4. An extension bar for a blast furnace tap hole drill according to claim 1 wherein said socket is at least 2 inches deep.

5. An extension bar for a blast furnace tap hole drill according to claim 5 wherein said socket is from 6 to 30 inches deep.

6. A blast furnace tap hole drill for drilling a tap hole in a blast furnace iron notch through which molten hot metal can be tapped, said drill having a drill rod assembly consisting at least of three components parts including a drill rod having a forward end secured to an extension bar and a drill bit secured to said extension bar, said extension bar comprising an elongated body portion having a forward end and a rearward end, means at said forward end for securing said drill bit, and a socket at said rearward end having a base and forming a protective sleeve with said body portion extending rearward from said base, said socket having means at the base thereof for securing said drill rod and having a diameter sufficient to receive said forward end of a drill rod and provide a gap between said protective sleeve and said drill rod inserted therein such that said protective sleeve will shield said forward end of said drill rod and any metal-to-metal interface between said drill rod and said extension bar.

7. A blast furnace tap hole drill according to claim 6 wherein a ceramic paste is disposed within said gap.

8. A blast furnace tap hole drill according to claim 6 wherein a ceramic sleeve is disposed within said gap.

9. A blast furnace tap hole drill according to claim 6 wherein said means for securing a drill bit comprises a threaded head portion onto which said drill bit can be secured.

10. A blast furnace tap hole drill according to claim 6 wherein said means for securing a drill rod comprised a threaded pilot hole into which said drill rod can be secured.

11. A blast furnace tap hole drill according to claim 6 wherein said socket is at least 2 inches deep.

12. A blast furnace tap hole drill according to claim 11 wherein said socket is from 6 to 30 inches deep.

13. A blast furnace tap hole drill according to claim 6 wherein said extension bar is cylindrical in form having a diameter slightly less that the drilling diameter of said drill bit so that said extension bar will occupy a major portion of any tap hole drilled by said drill bit to prevent a significant amount of hot metal from emerging from the blast furnace before said drill rod assembly is removed therefrom.

14. A blast furnace tap hole drill according to claim 13 wherein said extension bar has a diameter of from $\frac{1}{4}$ to $\frac{1}{2}$ inch less that the drilling diameter of said drill bit.

15. A blast furnace tap hole drill according to claim 6 further comprising a ceramic body disposed between the exposed interface between said extension bar and said drill bit.

16. A blast furnace tap hole drill according to claim 15 wherein said ceramic body is a ceramic washer.

17. A blast furnace tap hole drill according to claim 15 wherein said ceramic body is a ceramic sleeve.

* * * * *